US005236572A

United States Patent [19]

Lam et al.

[11] Patent Number: 5,236,572

[45] Date of Patent: Aug. 17, 1993

[54] PROCESS FOR CONTINUOUSLY ELECTROFORMING PARTS SUCH AS INKJET ORIFICE PLATES FOR INKJET PRINTERS

[75] Inventors: Si-Ty Lam, San Jose, Calif.; Paul H. McClelland, Monmouth, Oreg.

[73] Assignee: Hewlett-Packard Company, Palo Alto, Calif.

[21] Appl. No.: 626,808

[22] Filed: Dec. 13, 1990

[51] Int. Cl.[5] ..... C25D 1/08

[52] U.S. Cl. ..... 205/75

[58] Field of Search ..... 205/75

[56] References Cited

U.S. PATENT DOCUMENTS

| | | | |
|---|---|---|---|
| 3,414,487 | 12/1968 | Helms | 205/75 |
| 3,654,115 | 4/1972 | Langlais | 205/75 |
| 4,675,083 | 6/1987 | Bearss et al. | 204/11 |
| 4,773,971 | 9/1988 | Lam et al. | 204/11 |

FOREIGN PATENT DOCUMENTS

| | | |
|---|---|---|
| 902375 | 8/1962 | United Kingdom . |
| 1153638 | 5/1969 | United Kingdom . |
| 1215864 | 12/1970 | United Kingdom . |

OTHER PUBLICATIONS

Siewell, Gary L. et al., "The ThinkJet Orifice Plate: A Part With Many Functions", *The Hewlett-Packard Journal*, May 1985, pp. 33-37.

*Primary Examiner*—T. M. Tufariello

[57] ABSTRACT

A method for continuously manufacturing parts requiring precision micro-fabrication. According to the method, a surface of a mandrel having a reusable pattern thereon is moved through an electroforming bath. While the mandrel surface moves through the bath, a metal layer is deposited on the mandrel surface to define a pattern. After the metal layer has been deposited to the selected thickness, the metal layer is separated from the mandrel surface.

16 Claims, 1 Drawing Sheet

PROCESS FOR CONTINUOUSLY ELECTROFORMING PARTS SUCH AS INKJET ORIFICE PLATES FOR INKJET PRINTERS

BACKGROUND OF THE INVENTION

1. Field of the Invention

The present invention generally relates to a continuous process for forming parts by precision microfabrication and, more particularly, to a process for fabricating inkjet orifice plates for printheads of inkjet printers.

2. State of the Art

It is known to provide printheads for inkjet printers wherein the printheads each include a substrate, an intermediate barrier layer, and a nozzle plate including an array of nozzle orifices, each of which is paired with a vaporization chamber in the substrate. Also, a complete inkjet printhead includes mean that connect the vaporization cavities to a single ink supply reservoir.

In practice, the print quality of an inkjet printers depends upon the physical characteristics of the nozzles in its printhead. The geometry of a printhead orifice nozzle affects, for instance, the size, trajectory, and speed of ink drop ejection. In addition, the geometry of a printhead orifice nozzle affects the ink supply flow to the associated vaporization chamber and, in some instances, can affect the manner in which ink is ejected from adjacent nozzles.

In practice, nozzle plates for inkjet printheads often are fabricated from nickel in an lithographic electroforming processes. One example of a suitable lithographic electroforming process is described in U.S. Pat. No. 4,773,971, assigned to the Hewlett-Packard Company of Palo Alto, Calif. In the process described in the patent, nickel nozzle plates are formed with a reusable mandrel that includes a conductive material covered with a patterned dielectric layer. To form a nozzle plate, the reusable mandrel is inserted in an electroforming bath so that nickel is electroplated onto the conductive areas of the mandrel.

An article entitled "The ThinkJet Orifice Plate: A Part With Many Functions" by Gary L. Siewell et al. in the Hewlett-Packard Journal, May 1985, pages 33–37, discloses an orifice plate made by a single electroforming step wherein nozzles are formed around pillars of photoresist with carefully controlled overplating. More particularly, the article discloses that a stainless steel mandrel is: (1) deburred, burnished, and cleaned; (2) a layer of photoresist is spun on the surface and patterned to form protected areas for manifolds; (3) the exposed surface is uniformly etched to a specified depth; (4) the resist is removed and the mandrel is burnished and cleaned again; (5) a new coat of photoresist is spun on and patterned to define the barriers and standoffs; and (6) the barriers and standoffs are etched.

Further, the Siewell art discloses that the orifice plate can be made by: (1) laminating the stainless steel mandrel with dry film photoresist; (2) exposing and developing the resist so that circular pads, or pillars, are left for orifices or nozzles; (3) electroplating the mandrel with nickel on the exposed stainless steel areas including the insides of grooves etched into the mandrel to define the barrier walls and standoffs; (4) peeling the plating from the mandrel, the electroplated film being easily removed due to an oxide surface on the stainless steel which causes plated metals to only weakly adhere to the oxide surface; and (5) stripping the photoresist from the nickel foil. According to the article, the nickel foil has openings wherever the resist was on the mandrel. Still further, the article states that the resist is used to define edges of each orifice plate, including break tabs which allows a large number of orifice plates formed on the mandrel to be removed in a single piece, bonded to a mating array of thin-film substrates and separated into individual printheads.

SUMMARY OF THE INVENTION

Generally speaking, the present invention provides a continuous electroforming process and apparatus for manufacturing parts requiring precision micro-fabrication. In a preferred embodiment, the process includes a first step of moving a surface of a mandrel having a reusable pattern thereon through an electroforming bath, a second step of depositing a metal layer on the surface of the mandrel in the shape of the pattern while the mandrel surface moves through the bath, and a third step of separating the metal layer from the mandrel surface after the metal layer has been deposited to a selected thickness.

In practice, the mandrel can take various forms. For instance, the mandrel can be a movable belt. In an alternative embodiment, the mandrel can be a rotatable drum.

When the mandrel is a movable belt, the belt can be made, for instance, of a sheet of polymer material such as polyimide having a metallized thin film such as titanium or chromium/titanium thereon forming the reusable pattern. Alternatively, the belt can comprise a sheet of electrically conductive material having a dielectric material such as silicon carbide, nitride or oxide thereon for defining the reusable pattern.

When the mandrel is a drum, the drum can comprise an electrically conductive material such as stainless steel having a dielectric material thereon such as silicon carbide, nitride or oxide that define the reusable pattern. The electrically conductive material allows an electroplated layer of metal such as nickel to be built up thereon in the shape of the reusable pattern.

Preferably, the reusable pattern is in the shape of a device having details in microns in height, width and depth dimensions. More particularly, the device comprises an orifice plate and the reusable pattern defines the plate's features by photolithography.

BRIEF DESCRIPTION OF THE DRAWINGS

The present invention can be further understood by reference to the following description and attached drawings which illustrate the preferred embodiments. In the drawings.

DETAILED DESCRIPTION OF THE PREFERRED EMBODIMENTS

In the following, there will described a continuous electroforming process for manufacturing parts by precision micro-fabrication. The micro-fabricated parts can include, for example, orifice plates for printers, inkjet orifice plates, and masks for laser processing or for spectrophotometers.

In the micro-fabrication process, the first step comprises moving a surface of a mandrel having a reusable pattern thereon through an electroforming bath. The second step comprises depositing a metal layer on the surface of the mandrel in the shape of the reusable pattern while the mandrel surface moves through the bath. The third step comprises separating the metal layer from the mandrel surface after the metal layer has deposited to a selected thickness. In practice, the mandrel can take various forms. For instance, in one embodiment, the mandrel is in the form of a movable belt. In another embodiment, the mandrel is in the form of a rotatable drum.

Figure 1:
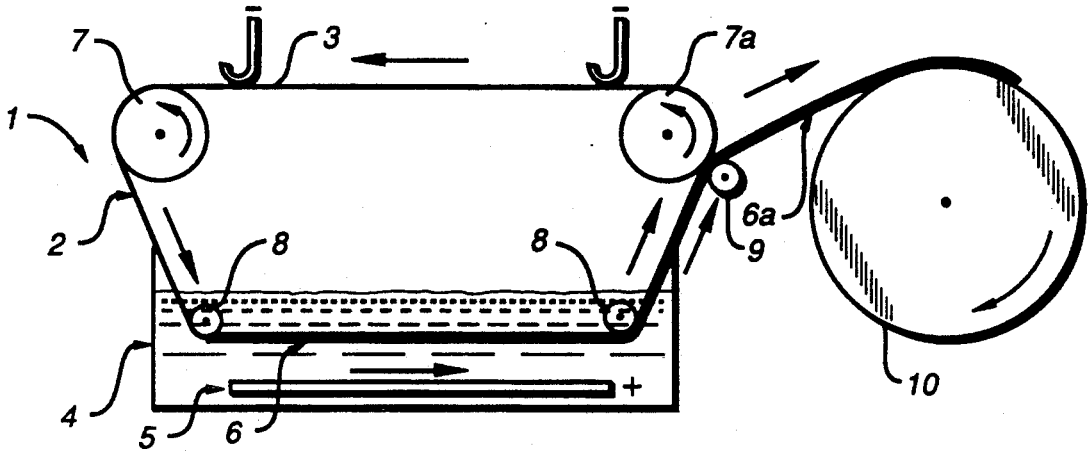
FIG. 1 shows an apparatus useful for carrying out one embodiment of a process according to the invention.

FIG. 1 shows an electroforming apparatus 1 wherein the mandrel 2 is in the form of a moving belt 3. (The belt 3 is shown by itself in FIG. 2.) In the illustrated embodiment, the belt 3 moves through an electroforming bath 4 which includes an anode 5 such as a sacrificial nickel anode. In operation of the electroforming apparatus, current is applied between the anode 5 and the belt 3. As a result, the belt acts as a cathode, and a metal layer 6 is deposited onto it.

Figure 2:
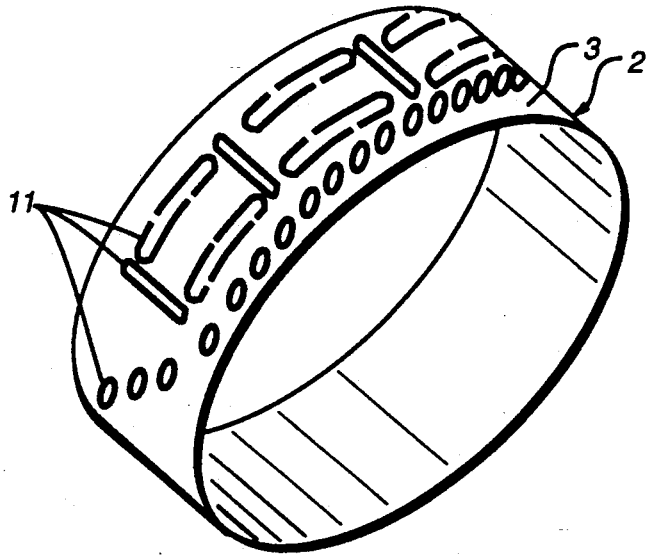
FIG. 2 shows a component of the apparatus shown in FIG. 1.

In the embodiment shown in FIGS. 1 and 2, belt 3 is an endless belt supported for rotation in, for example, the counterclockwise direction. In this embodiment, belt 3 is supported by driven rollers 7 and 7*a* located outside the bath 4, while guides 8 are immersed in the bath 4. The deposited metal layer 6 is separated from the belt 3 outside the bath 4 at a location adjacent the intersection of a guide 9 and one of the driven rollers 7*a*. The separated metal layer 6*a* is then wound on a reel 10.

With particular reference to the belt 3 in FIG. 2, it should be noted that the belt includes details of a reusable pattern 11 having microfine dimensions. In the embodiment shown, the belt 3 includes a lower section which moves in a rectilinear path and the anode 5 is parallel to the rectilinear path and faces the lower section of the belt.

When the mandrel is a movable belt, it can comprise a sheet of polymer material such as polyimide having a metallized thin film such as titanium or chromium/-titanium thereon forming the reusable pattern. Alternatively, the belt can comprise a sheet of electrically conducive material having a dielectric material such as silicon carbide, nitride or oxide thereon for defining the reusable pattern on the electrically conductive material. Preferably, the belt is about 4 mils thick.

Alternatively, the mandrel can be a drum comprised of an electrically conductive material such as stainless steel or other metals (including copper, brass, and steel coated with electroless nickel) having a dielectric material thereon (such as silicon carbide, nitride or oxide) for defining the pattern on the radially outer surface of the drum.

In the case where the mandrel 2 is belt 3, the metallized thin film can be applied by process such as vacuum deposition. More particularly, in this case, the belt can comprise a layer of titanium on a sheet of polyimide. The polyimide material can be, for instance, "KAPTON" which is a product of DuPont or "UPILEX" which is a product of Ube Company of Japan. Alternatively, the metallized thin film can comprise a first layer of chromium which improves adhesion and a second layer of titanium. As still another alternative, the belt can be a layer of titanium on a polyimide sheet with a layer of dielectric material such as silicon nitride on the titanium layer. The dielectric material can be applied by, for instance, a process such as vacuum deposition.

The belt can be fabricated in a number of ways. For instance, a thin metal film can be metallized on a polyimide substrate. The metallized film is preferably mirror polished to provide the highest quality parts when electroforming the metal layer on the belt. The reusable pattern 11 on the belt 3 can be defined by photolithography so as to provide a photoresist having a shape of the pattern 11 on the thin metal film. The thin metal film is etched such as by chemical etching, dry etching or plasma etching through to the polyimide substrate such that the thin metal film which remains after the etching has the shape of the photoresist. Then, the photoresist is removed to provide the belt 3 with the reusable pattern 11 thereon.

Another way of making the belt is as follows. First, a sheet of polymer material such as polyimide is coated by a process such as by sputter depositing with a layer of electrically conductive material such as titanium or a first layer of chromium and a second layer of titanium over the chromium. Then, the electrically conductive material is coated with a layer of dielectric material such as silicon carbide, nitride or oxide. Then the reusable pattern 11 is defined by photolithography so a to provide a photoresist mask having a shape that defines the reusable pattern 11 on the dielectric layer. The dielectric layer is then etched such as by chemical etching, dry etching or plasma etching through to the electrically conductive material such that the dielectric layer which remains after the etching step has the shape of the photoresist. Then the photoresist is removed thereby providing the belt 3 with the pattern 11 thereon.

The drum can be prepared in a similar manner. In particular, in the case where the drum is of stainless steel, the pattern 11 can be defined on the drum's outer periphery by photolithography. One advantage of this is that the insulating or dielectric material defines the pattern 11.

In the above-described electroforming process, it is preferred that the deposited metal layer 6 is separated from the mandrel 2 outside the bath 4 after the deposited metal layer 6 has a selected thickness. To control the thickness of the deposited metal layer 6, adjustments can be made to the current applied between anode 5 and mandrel 2, or to the speed that the surface of the mandrel 2 moves through the bath 4.

The bath 4 can comprise a nickel-Watts bath, a nickel-sulfamate bath or any other suitable bath. The anode can be a sacrificial anode or the deposited metal layer 6 can be obtained directly from the electrolyte forming the bath. In the case where a nickel-Watts bath is used, the bath can contain nickel chloride, nickel sulfate, boric acid and organic additives such as a leveler, a brightener and a stress reducer.

When the above-described process is used to manufacture inkjet orifice plates, the pattern 11 on the mandrel can be used for forming inkjet orifice plates. Accordingly, the deposited metal layer 6 separated from the mandrel 2 will include a plurality of plates, each having the shape and features of an inkjet orifice plate with the plates being connected together in the form of a continuous sheet. The process can further include a step of bonding the plates to suitable thin-film substrates and a step of separating the bonded plates and substrates into individual printheads.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of present invention as defined by the following claims.

What is claimed is:

1. A continuous electroforming process for forming inkjet orifice plates and similar parts requiring precision micro-fabrication, the process comprising:

a first step of moving a surface of a mandrel having a reusable micro-fabrication pattern thereon through an electroforming bath wherein details of the pattern have microfine dimensions;

a second step of depositing a metal layer on the surface of the mandrel while the surface of the mandrel moves through the electroforming bath until the metal layer is deposited in the pattern on the surface of the mandrel, wherein the metal layer directly contacts the details of the pattern; and a third step of separating the metal layer from the surface of the mandrel after the metal layer is deposited in the second step.

2. The process of claim 1, wherein the mandrel comprises a moving belt.

3. The process of claim 2, wherein the belt comprises a sheet of electrically conductive material having a dielectric material thereon which defines the pattern.

4. The process of claim 1, wherein the mandrel comprises a rotating drum.

5. The process of claim 1, wherein the drum comprises an electrically conductive material of stainless steel having a dielectric material thereon which defines the pattern.

6. The process of claim 3, wherein the dielectric material is a material selected from the group consisting of silicon nitride, carbide and oxide.

7. The process of claim 1, wherein the thickness of the metal layer deposited in the second step is controlled by adjusting an applied current between the mandrel and an anode in the electroforming bath.

8. The process of claim 1, wherein the thickness of the metal layer deposited in the second step is controlled by adjusting a speed at which the mandrel surface moves through the electroforming bath.

9. The process of claim 1, wherein the metal layer applied in the second step comprises nickel.

10. The process of claim 1, wherein the mandrel comprises a flexible moving belt.

11. The process of claim 1, wherein the mandrel comprises a moving belt having a lower section that follows a rectilinear path through the bath.

12. The process of claim 2, wherein the belt includes a thin film of electrically conductive material having a dielectric material thereon outlining the pattern.

13. A continuous electroforming process for forming inkjet orifice plates and similar parts requiring precision micro-fabrication, the process comprising:

a first step of moving a surface of a mandrel having a reusable pattern thereon through an electroforming bath wherein the mandrel includes a moving belt comprising a sheet of polymer material having a metallized thin film thereon forming the pattern;

a second step of depositing a metal layer on the surface of the mandrel while the surface of the mandrel moves through the electroforming bath until the metal layer is deposited in the pattern on the surface of the mandrel; and a third step of separating the metal layer from the surface of the mandrel after the metal layer is deposited in the second step.

14. The process of claim 13, wherein the metallized thin film comprises a layer of titanium.

15. The process of claim 13, wherein the metallized thin film comprises a first layer of chromium and a second layer of titanium, the chromium layer being between the sheet of polymer material and the layer of titanium.

16. The process of claim 13, wherein the mandrel includes a thin film of electrically conductive material having a dielectric material thereon outlining the pattern.

* * * * *